US010267066B2

(12) United States Patent
Fan

(10) Patent No.: US 10,267,066 B2
(45) Date of Patent: Apr. 23, 2019

(54) PADLOCK

(71) Applicant: ABUS August Bremicker Söhne KG, Wetter-Volmarstein (DE)

(72) Inventor: Wai Kuen Fan, Kowloon (HK)

(73) Assignee: ABUS AUGUST BREMICKER SÖHNE KG, Wetter-Volmarstein (DE)

( * ) Notice: Subject to any disclaimer, the term of this patent is extended or adjusted under 35 U.S.C. 154(b) by 217 days.

(21) Appl. No.: 15/288,226

(22) Filed: Oct. 7, 2016

(65) Prior Publication Data

US 2017/0101808 A1 Apr. 13, 2017

(30) Foreign Application Priority Data

Oct. 9, 2015 (DE) ..... 10 2015 117 253

(51) Int. Cl.
*E05B 67/00* (2006.01)
*E05B 15/00* (2006.01)
(Continued)

(52) U.S. Cl.
CPC ..... *E05B 67/003* (2013.01); *E05B 15/0053* (2013.01); *E05B 67/063* (2013.01); *E05B 67/24* (2013.01)

(58) Field of Classification Search
CPC . Y10T 70/459; E05B 67/003; E05B 15/0053; E05B 67/063; E05B 67/24; E05B 67/22
(Continued)

(56) References Cited

U.S. PATENT DOCUMENTS 1,679,665 A * 8/1928 Junkunc ..... B62D 43/02 70/260
3,855,824 A * 12/1974 Falk ..... E05B 63/121 70/38 A
(Continued)

FOREIGN PATENT DOCUMENTS

DE 4322989 A1 1/1995
DE 4329511 A1 3/1995
(Continued)

*Primary Examiner* — Lloyd A Gall
(74) *Attorney, Agent, or Firm* — Harness, Dickey & Pierce, P.L.C.

(57) ABSTRACT

A padlock comprises a lock body and a hoop, in particular a flexible hoop, which has a first hoop end. In this respect, the lock body has a first hoop receiver in order to selectively receive the first hoop end therein. The lock body further comprises a blocking element which is displaceable between a blocked position in which it blocks the first hoop end against an exiting from the first hoop receiver and a release position in which it releases the first hoop end for an exiting from the first hoop receiver. The lock body furthermore comprises a drive element which is rotatable between a locked position in which it locks the blocking element in its blocked position and an unlatched position in which it permits a displacement of the blocking element into its release position. The drive element in turn comprises a rotary body and a latch element which is displaceably supported at the rotary body, with the latch element being preloaded toward the blocking element in the unlatched position in order to secure the blocking element against an automatic displacement into the release position.

28 Claims, 4 Drawing Sheets

(51) Int. Cl.
*E05B 67/06* (2006.01)
*E05B 67/24* (2006.01)

(58) Field of Classification Search
USPC ..... 70/20, 21, 35, 24–26, 38 R, 38 A, 38 B, 70/38 C, 39, 30, 49, 51, 379 R, 379 A, 70/380, 386
See application file for complete search history.

(56) References Cited

U.S. PATENT DOCUMENTS 4,158,952 A * 6/1979 Oliver ..... E05B 67/24 70/367
4,848,110 A * 7/1989 Kuo ..... B60R 25/0221 70/238
5,189,893 A 3/1993 Kortenbrede
5,394,712 A * 3/1995 Chou ..... E05B 67/063 70/226
6,453,706 B1 * 9/2002 Chen ..... E05B 67/36 70/226
6,694,781 B1 * 2/2004 Li ..... B60D 1/06 280/507
7,121,121 B2 * 10/2006 Wyers ..... B60D 1/065 70/14

FOREIGN PATENT DOCUMENTS

DE 20221695 U1 1/2007
DE 102011009591 A1 8/2012
DE 102013222422 A1 5/2015

* cited by examiner

PADLOCK

The present invention relates to a padlock having a lock body and a hoop.

The hoop of a padlock typically has two hoop ends of which one is permanently connected to the lock body, while the other one can be selectively connected to the lock body such that the hoop and the lock body form a closed loop. In this closed state, the padlock can be locked such that the hoop cannot be released from the lock body. This is only possible again when the padlock is unlatched. In order to prevent an unauthorized unlatching and possibly also locking of the padlock, the padlock as a rule has a closing mechanism which is coded and which can only be actuated by means of an associated key or one of a plurality of associated keys.

The lock body of the padlock can have a hoop receiver in which an end of the hoop can be selectively received. In order to block the hoop in a closed position in which the hoop end is received in the hoop receiver, the lock body can comprise a blocking element which is displaceable between a blocked position in which it blocks the hoop end against an exiting from the hoop receiver and a release position in which it releases the hoop end for an exiting from the hoop receiver. The displacement is in particular a linear displacement.

In order to control when the blocking element can adopt which position, the lock body can furthermore comprise a drive element which is rotatable between a locked position in which it locks the blocking element in its blocked position and an unlatched position in which it permits a displacement of the blocking element into its release position. The locked position and the unlatched position of the drive element are consequently rotational positions of the drive element which differ in their respective rotational alignments relative to an axis of rotation of the drive element. The blocking element can in particular be urged into the blocked position, in which it is then locked, by a rotation of the drive element into the locked position. In this respect, the displaceability of the blocking element is in particular aligned radially with respect to the axis of rotation.

The drive element can be operatively coupled to a respective closing mechanism to rotate the drive element between the locked position and the unlatched position.

A locking actuation at the closing mechanism is then transferred to the drive element which is thereby rotated into its locked position, whereby it possibly displaces the blocking element into the blocked position and in any case locks it in the blocked position such that the hoop end received in the hoop receiver cannot exit the hoop receiver. The drive element is rotated into the unlatched position by an opposite unlatching actuation, whereby a displacement of the blocking element into its release position is made possible. Therefore, the hoop end can then be removed from the hoop receiver.

Such a padlock is known from DE 10 2011 009 591 A1 or from DE 10 2013 222 422 A1, for example.

Padlocks can be used for various purposes, in particular for connecting two objects, for securing an object at another object or for securing an object against an unauthorized actuation. For this purpose, the hoop is guided in a respectively suitable manner through the respective object or through the respective objects. A particularly large variability of the application results in this respect when the hoop is configured as flexible, for instance, as a cable, as a chain or as a belt. For the hoop is then particularly easily adaptable with respect to its spatial extent. Flexible hoops can, for example, be useful for lockout-tagout applications in which the padlock should, for instance, block an adjustment member of a plant against an actuation. In this respect, it can, for example, be a valve wheel in which the hoop has to be threaded through between the spokes of the valve wheel. Or the hoop should block a plurality of switches of a plant which are arranged distributed such that it has to be installed in accordance with the switch arrangement.

A further application for which flexible hoops are particularly suitable is the securing of guns which, for example, takes place in that the hoop of a padlock is led through the barrel or through the cartridge chamber of a discharged weapon.

While padlocks are known whose hoops are conveyed out, in particular jump out, of the lock bodies on an unlatching actuation (at least by one hoop end), it can be preferred that the hoop end which is generally releasable from the lock body is initially still held in the hoop receiver even in the unlatched state of the padlock and only exits the hoop receiver on a sufficient influence of force by way of which an unintentional automatic exiting of the hoop end from the hoop receiver can be excluded as a rule. This is, for instance, advantageous when the padlock or the hoop would otherwise fall in an uncontrolled manner, jump away or unwantedly move automatically in another manner on the unlatching due to gravity, a tensile stress or other influences. If in contrast to this the hoop end is indeed released, but is nevertheless initially still secured in the hoop receiver, i.e. is held by a force which can be overcome, then the lock body and the hoop can be gripped after the unlatching actuation in order to release them from one another in a controlled manner.

Flexible hoops can in particular shoot out of the hoop receiver on an unlatching of the padlock due to their respective bending stiffness against whose restoring force the hoop end was introduced into the hoop receiver in order to close the padlock. The locking can also be made more difficult with a padlock having a flexible hoop if the hoop end simultaneously has to be held tight in the hoop receiver during the locking actuation against a restoring force or against the gravity.

Mechanisms for securing a releasable hoop end at the lock body even with a padlock which is already unlatched or still unlatched are known. However, in particular due to the plurality of required components, these mechanisms are comparatively complex from a construction aspect both with respect to their production and with respect to their assembly, which leads to increased costs in the manufacture.

It is for this reason an object of the invention to provide a padlock which provides a simple handling which has a flexible applicability with a simultaneously low complexity from a construction aspect.

The object is satisfied by a padlock having the features, in particular in that the drive element comprises a rotary body and a latch element which is displaceably supported at the rotary body relative to the rotary body, with the latch element being preloaded toward the blocking element in the unlatched position in order to secure the blocking element against an automatic displacement into the release position.

The drive element is therefore at least configured in two parts in such a padlock. Since the drive element is rotatable between the locked position and the unlatched position, the rotary body and the latch element of the drive element in this respect also rotate together between these positions. But for all that, this rotational movability is additionally superimposed by a displaceability relative to the rotary body with regard to the latch element. Generally, the latch element can for this reason furthermore also be displaced between different positions relative to the rotary body in every possible rotational position of the rotary body, wherein the displacement is in particular linear. The extent of the displaceability can in this respect be restricted differently in dependence on the respective rotational position.

The latch element is displaceable in the unlatched position such that it is preloaded toward the blocking element in the direction of its displaceability. The latch element is therefore acted on by a force which urges it toward the blocking element. However, it can be displaced in the opposite direction against the preload, for which purpose a correspondingly high force has to be applied in order to overcome the preload.

The latch element in this respect preferably contacts the blocking element directly such that a direct influence of force takes place. However, one or more further elements can generally be arranged between the latch element and the blocking element, via which further elements the influence of force caused by the preload of the latch element is transferred to the blocking element and an influence of force which starts from the blocking element and is opposed to the preload is possibly transferred to the latch element in the reverse direction.

In the unlatched position, the blocking element is therefore indeed not locked in the blocked position, but is rather generally unlatched for a displacement into the release position. The blocking element nevertheless does not exit the blocked position due to the preload of the latch element toward the blocking element. For this purpose, a force threshold defined by the preload has to first be overcome, said force threshold preferably being dimensioned such that an automatic displacement of the blocking element, that is, for instance, due to the weight of the padlock and/or to a restoring force caused by the bending stiffness of the hoop, is avoided.

Due to the fact that the drive element is at least configured in two parts as a rotary body and as a preloaded latch element which is displaceable relative to the rotary body, the drive element can, in a comparatively simple manner from a construction aspect, also, in addition to the typical locking and unlatching function, have the desired securing function, with which the hoop end is held in the hoop receiver (called the first hoop end respectively the first hoop receiver in the following) even for an unlatched padlock, but which can be released by overcoming a force threshold.

The rotary body can in particular be that part of the drive element which is primarily driven to make a rotation on an unlatching actuation or locking actuation of the padlock, whereas the latch element is only rotated along indirectly via the rotary body.

Due to the fact that the latch element is displaceable and preloaded relative to the rotary body, the latch element is advantageously supported with respect to the rotary body. This has the advantage of a simplified assembly with respect to a latch element which does not co-execute the rotation of the drive element and/or which is supported with respect to a stationary element, for instance the housing, of the padlock. For the named securing function can, for example, be achieved by a simple replacement of a conventional drive element with the described (at least) two-part drive element having a preloaded latch element, while the remaining components of a conventional padlock can substantially remain unchanged.

The preloaded latch element therefore in particular does not need to be laterally introduced into the lock body through an additional bore or opening, but can preferably be inserted together with the remaining drive element through a possibly anyway present receiver for a closing mechanism such as a lock cylinder of the padlock. This has the advantage that a housing of the lock is not impaired by the additional opening and can therefore be completely prefabricated, in particular also coated or colored. For if the latch element were inserted through an additional opening, it would subsequently still have to be closed as unobtrusively and reliably as possible (e.g. by means of a brass plug or a plastic insert depending on the material of the housing). Particularly for the case of a coated or colored housing this is not possible in an unobtrusive manner, such that a completely new coating or coloring would have to be applied after the assembly or could only take place at all after the assembly. The assembly is additionally simplified in that the step of closing an additional opening is dispensed with.

In order to be able to be blocked by the blocking element against an exiting from the first hoop receiver, the first hoop end in particular has a peripheral restriction into which the blocking element engages when the first hoop end is received in the first hoop receiver and the blocking element is in the blocked position. Such a restriction allows a holding of the first hoop end in a specific position which is an axial position with respect to the longitudinal extent of the first hoop end (or in a specific axial position range). In this respect, the hoop end can, however, remain rotatable about its longitudinal extent so that torsional forces are avoided.

The latch element is preferably at least substantially radially displaceable with respect to an axis of rotation of the drive element about which the drive element is rotatable between the locked position and the unlatched position. The force exertion of the latch element toward the blocking element, which is brought about by the preload, then in particular likewise takes place in a radial direction with respect to the named axis of rotation.

It is furthermore preferred if the rotary body has a latch receiver in which the latch element is at least partly received. It can thus be ensured in a simple manner that the rotary body and the latch element are rotated together on an unlatching actuation or on a locking actuation. The displaceability of the latch element relative to the rotary body can in particular precisely comprise the fact that the latch element is able to be received at different depths in the latch receiver. In accordance with a preferred embodiment, a spring element is further received in the latch receiver, said spring element preloading the latch element in the direction out of the latch receiver. The spring element can in this respect in particular be supported between a base of the latch receiver and an end face of the latch element facing into the latch receiver. The spring element is in this respect preferably captured in the latch receiver by way of the latch element so that it cannot be lost. A respective depression can furthermore be provided for receiving a part of the spring element in the named base of the latch receiver and/or in the named end face of the latch element. The correct alignment of the spring element in the latch receiver can hereby be simplified and stabilized.

The named latch receiver is preferably aligned in the direction of the blocking element in the unlatched position. A cooperation of the latch element which is at least partly received in the latch receiver with the blocking element is hereby achieved, said cooperation being frontal in the unlatched position. In this respect, the displaceability of the latch element and the displaceability of the blocking element can in particular be aligned in parallel. Such an embodiment results in a particularly good force transfer between the latch element and the blocking element.

In accordance with a further advantageous embodiment, a cross-section of the latch receiver and a cross-section of the latch element are formed in a complementary manner with respect to one another. The latch element can then therefore be inserted into the latch receiver with an exact fit, wherein it in particular contacts an inner surface of the latch receiver across its complete periphery. On a displacement of the latch element, the peripheral surface of the latch element then advantageously slides along the inner surface of the latch receiver such that the latch element is particularly stable and is in particular reliably guided in a straight line.

The latch receiver and the latch element are preferably configured in such a manner that a rotational alignment of the latch element is fixed in the latch receiver. The rotational alignment in this respect relates to the direction of the displaceability of the latch element. The latch element can therefore not be inserted into the latch receiver in any desired rotational alignment, but only in a predefined rotational alignment, and can consequently also not be rotated even in the latch receiver. This can, for example, be achieved by a cross-section which is asymmetrical overall or which at least does not have any rotational symmetry.

In accordance with a further embodiment, the blocking element at least substantially has a spherical shape. The blocking element is in particular a blocking ball. This has the advantage that a correct spatial alignment of the blocking element does not have to be ensured on the assembly. In this respect, a blocking element having a spherical shape is, on the one hand, well suited for a reliable force transfer between the drive element and the first hoop end; on the other hand, a blocking element having a spherical shape can easily be led in a passage with a round cross-section, which passage is provided for the sphere and can be formed in a simple manner by a bore in the lock body.

It is furthermore advantageous if the latch element has a cylindrical basic shape, wherein a transition from a jacket surface of the latch element is rounded off or chamfered toward an end face facing the blocking element in the unlatched position. The latch element can in particular at least substantially be made in pin form, for instance. If the latch element is preloaded toward the blocking element in the unlatched position, its end face can in particular act on the blocking element.

However, for this purpose, the end face first has to be correspondingly placed on the rotation of the drive element from the locked position into the unlatched position. In particular having regard to a radially displaceable latch element, the latch element in this respect has to be led past the blocking element with an edge formed at the margin of the end face. The rounding off or chamfering of this edge, which forms a transition from the jacket surface of the latch element to the end face, then facilitates the leading past.

In this respect, the edge does not need to be rounded off or chamfered across the complete periphery of the end face, in particular for a latch element which is clearly rotationally aligned in the latch receiver. It is rather preferred if the named transition only comprises a part of the edge such that the transition is radially (with respect to a cylinder axis of the cylinder shape of the latch element) particularly aligned such that it is led past the blocking element on the rotation of the drive element from the locked position into the unlatched position.

The latch element can in particular have a cylindrical basic shape whose cross-section is a circular segment such that the latch element has a flat side which is radial (with respect to a cylinder axis of the cylinder shape of the latch element). Such a cross-section can advantageously have the consequence that the latch element is held rotationally fixedly (with respect to the cylinder axis) in the latch receiver with a corresponding configuration of the latch receiver.

It is also preferred in this embodiment if a transition from the named flat side is rounded off or chamfered toward an end face of the latch element facing the blocking element in the unlatched position and is aligned in such a manner that it is led past the blocking element on the rotation of the drive element from the locked position into the unlatched position. Since the transition from the flat side to the end face is straight, unlike the remaining margin of the end face, it is particularly suitable for the formation of the rounding off or chamfer.

Overall, a latch element configured in such a manner is comparatively simple to produce, since a cylinder-shaped pin can, for instance, be assumed, wherein the pin is then e.g. provided in a cutting manner with a flat side which is radial (with respect to the cylinder axis) and/or the initially edged margin of the end face of the pin is at least rounded off or chamfered in a specific angular range (in particular in the angular range corresponding to the flat side).

In a preferred embodiment, the rotary body has a cylindrical basic shape with a jacket surface which locks the blocking element in its blocked position in the locked position and which has a recess which is aligned toward the blocking element in the unlatched position and which permits a displacement of the blocking element into its release position. The axis of rotation of the rotational movability of the rotary body in this respect advantageously coincides with the cylinder axis of the cylinder. The blocking element is therefore guided at the jacket surface on a rotation of the drive element (directly or indirectly via one or more elements arranged therebetween). The rotary body is in this respect configured such that the jacket surface locks the blocking element in its blocked position; that is, it does not permit an exiting from the blocked position. However, the jacket surface has a recess into which the blocking element (or an element arranged therebetween) can penetrate depending on the rotational position of the rotary body such that it can exit the blocked position and adopt the release position.

The locking effect of the jacket surface is therefore cancelled by the recess in a specific rotational position range of the rotary body. Whether the locking is cancelled thus depends on the rotational position of the rotary body. An alignment of the recess toward the blocking element such that it can be displaced into the release position in the direction of the recess consequently corresponds to the unlatched position; in the locked position, in contrast, the recess is aligned such that it does not provide any space for a yielding back of the blocking element so that the blocking element is held in its blocked position by the jacket surface. The blocking element is preferably additionally urged into its blocked position, if it is not already present therein, by way of the transition from the recess to the remaining jacket surface on a rotation of the drive element out of the unlatched position in the direction of the locked position.

The jacket surface is preferably formed concavely, in particular in the form of a restriction which is advantageously adapted to the shape of the blocking element in a similar manner to a possibly present restriction at the hoop end. On a rotation of the rotary body, the jacket surface and the blocking element can then slide on one another particularly easily, in particular with a substantially exact fit. In addition, a force transfer between the jacket surface and the blocking element then does not only take place pointwise.

In accordance with a preferred further development, the latch element extends into the recess while it secures the blocking element against an automatic displacement into the release position. The named latch receiver can in particular open into the recess. The latch element can thereby so-to-say fill up the recess within the framework of its displaceability to such an extent that it cooperates with the blocking element in the unlatched position like a continuation of the remaining jacket surface and holds said blocking element in its blocked position. In contrast to the remaining jacket surface, the latch element is, however, displaceable against the preload such that it does not completely prevent the blocking element from exiting from the blocked position, but rather only secures said blocking element in the blocked position by a force threshold which can be overcome. By overcoming the force threshold, the blocking element can then therefore nevertheless be displaced against the preload into the recess.

It is furthermore advantageous if the lock body comprises a lock cylinder which is operatively coupled to the drive element, in particular to the rotary body, in order to rotate the drive element between the locked position and the unlatched position in dependence on an actuation of the lock cylinder. A lock cylinder represents a proven means to ensure that an actuation of the drive element cannot take place in an unauthorized manner. The unlatching and possibly also the locking of the padlock can in particular only take place by means of a closing means, for example a key, associated with the padlock.

Having regard to the lock cylinder, the unlatching actuation and the locking actuation can in particular be rotational actuations which are, for instance, transferred to the drive element via an entrainer of the lock cylinder, preferably by an engagement which is shape-matched (with respect to the direction of rotation). Generally, intermediate elements can also be provided between the entrainer and the drive element. The drive element, in particular the rotary body of the drive element, can, however, also be provided directly at the lock cylinder so that the formation of an entrainer at the lock cylinder is then not required.

It is particularly preferred if, in the unlatched position of the drive element, the latch element is preloaded in the direction of a rotation-blocking position in which the latch element blocks a rotation of the drive element into the locked position. Such a blocking of a locking actuation is in particular advantageous when the padlock is open, that is the first hoop end is not located in the first hoop receiver. If the first hoop end is, in contrast, received in the first hoop receiver and can therefore be locked, the drive element should remain rotatable unchanged to lock the padlock into the locked position.

The latch element is therefore preferably blocked against a displacement into the rotation-blocking position as long as the first hoop end is received in the first hoop receiver. From this it follows vice versa that as soon as the first hoop end is no longer received in the first hoop receiver, the latch element is no longer prevented from a displacement into the rotation-blocking position. As a consequence, the latch element is automatically displaced into the rotation-blocking position due to the preload on the removal of the first hoop end from the first hoop receiver and thus prevents a locking actuation when the padlock is open.

In this manner, a so-called forced locking can be achieved in which the padlock can only be displaced into a locked state when it is also actually closed. The lock cylinder of the padlock is in this respect in particular configured such that the associated key can only be removed from the lock cylinder in the locked position of the lock cylinder. As a rule, this is in particular the case with lock cylinders having pin tumblers, but it can also be implemented in a different manner. The key can therefore overall only be removed when the padlock is closed (i.e. the first hoop end is received in the first hoop receiver) and locked (i.e. the drive element holds the blocking element in the blocked position by which the first hoop end which is possibly received in the first hoop receiver is prevented from exiting from the first hoop receiver).

Such a forced locking is particularly important and useful in the field of lockout-tagout applications and weapon keys. A user of the padlock can assure himself, with reference to the key which is removed and carried along, that the padlock necessarily has to be closed and locked. It is additionally preferred in this respect if only a single key is associated with the respective lock cylinder to preclude the padlock from being opened by means of a further key.

The latch element is preferably blocked against a displacement into the rotation-blocking position by the blocking element as long as the first hoop end is received in the first hoop receiver. In this embodiment, an additional blocking mechanism is therefore not necessary to control when the latch element can adopt the rotation-blocking position and when not. The blocking element which is anyway provided can rather be used for this purpose. The blocking element is in this respect particularly well suited for the purpose of determining whether the first hoop end is received in the first hoop receiver or not, since it preferably cooperates directly with the first hoop end in a blocking or releasing manner when it is received in the first hoop receiver.

For example, the blocking element can, in addition to its displaceability between the release position and the blocked position, furthermore be displaceable beyond the blocked position in the direction toward the first hoop receiver, wherein the blocking element is blocked by the first hoop end against a displacement in the direction of the first hoop receiver beyond the blocked position as long as the first hoop end is received in the first hoop receiver. In this respect, the named displacement of the hoop beyond the blocked position can in particular allow a displacement of the latch element into the rotation-blocking position, whereas the latch element cannot adopt the rotation-blocking position as long as the blocking element is present in the blocked position, in the release position or therebetween. The displaceability of the latch element can therefore be variably limited via the blocking element, wherein the accessibility of the rotation-blocking position then depends directly on whether the first hoop end is received in the first hoop receiver or not.

It is furthermore advantageous in connection with the rotation-blocking position if, in the rotation-blocking position, the latch element abuts a stationary element of the lock body on a rotational actuation in the direction of the locked position, whereby a rotation of the drive element into the locked position is blocked. The blocking effect of the latch element in the rotation-blocking position is therefore achieved in cooperation with a stationary element which in this respect forms an abutment. If a rotational actuation takes place in the unlatched position, that is a torque is exerted onto the drive element in the direction of the locked position, it depends on the position of the latch element whether the rotation into the locked position can actually take place. If the latch element is present in the rotation-blocking position, it abuts the abutment and prevents the rotation; otherwise it can be led past the abutment so that the rotation is possible.

The lock body preferably has a passage in which the blocking element is displaceably supported and into which the latch element engages in the rotation-blocking position. The named stationary element can therefore in particular be formed by the passage, wherein a side wall of the passage then forms the named abutment. In such an embodiment, a separate abutment thus does not need to be provided. Instead, the latch element, when it is displaced into the rotation-blocking position, at least partly penetrates into the passage which is anyway provided for the blocking element and thus blocks a rotational actuation into the locked position. The displacement of the latch element into the passage is in this respect in particular only made possible if the first hoop end has been removed from the first hoop receiver, and indeed in that the blocking element can be urged back in the passage beyond its blocked position as a consequence of the first hoop end removed from the first hoop receiver.

Overall, in the unlatched position of the drive element, the latch element can thus preferably be displaceable between a release position, a neutral position and the named rotation-blocking position. In this respect, the release position of the latch element corresponds to the release position of the blocking element. The latch element can in particular be urged into this release position against the preload in that the blocking element is displaced into its release position. The neutral position of the latch element furthermore corresponds to the blocked position of the blocking element. The latch element is preloaded from the release position into this neutral position and consequently (directly or indirectly) acts on the blocking element such that it secures the blocking element against an automatic displacement into its release position.

The neutral position can in this respect substantially correspond to the continuation of a jacket surface of the rotary body by which the blocking element is locked in its blocked position when the drive element is present in the locked position. In the locked position of the drive element, the blocking element is thus held in the blocked position by the jacket surface in the sense of an absolute locking, whereas, in the unlatched position of the drive element, it is only held in the blocked position by the latch element in the sense of a securing which can be overcome.

The latch element preferably also maintains the relative position with respect to the rotary body, which the latch element adopts in the neutral position, during a rotation between the locked position and the unlatched position, for instance, in that the latch element is guided at the wall of a rotary body receiver against its preload and is thereby held in this relative position. A substantially seamless transition between the locked position and the unlatched position thus results.

In accordance with a further embodiment, the hoop has a second hoop end which is permanently connected to the lock body and is in particular permanently received in a second hoop receiver of the lock body. The second hoop end can in this respect have a certain movability relative to the lock body; it can in particular be rotationally movable about a longitudinal axis of the second hoop end and/or, to a limited degree, can be longitudinally displaceable along the longitudinal axis. However, the second hoop end cannot be released from the lock body on normal use of the padlock.

To fasten the second hoop end to the lock body, the lock body can in particular comprise a further blocking element which blocks the second hoop end against an exiting from the second hoop receiver in a blocked position, wherein the drive element locks the further blocking element in its blocked position both in the locked position and in the unlatched position. In this respect, the drive element of the padlock consequently cooperates with both blocking elements at the same time. In such an embodiment, the second hoop end is therefore locked in its respective hoop receiver in a very similar manner to the first hoop end, but with the difference that the locking is independent of the rotational position of the drive element and is consequently permanent.

Such an embodiment in particular has the advantage that the same components can be used for the second hoop end and for the further blocking element as for the first hoop end or for the blocking element cooperating therewith. In addition, the same tool, e.g. the same drill, can be used for the manufacture of the second hoop receiver as for the first hoop receiver.

However, the second hoop end does not necessarily have to be permanently connected to the lock body. It is generally also conceivable that the second hoop end is selectively connectable to the lock body just like the first hoop end. It is then particularly important for such a padlock that the hoop ends are secured in the respective hoop receivers even if they are not yet or no longer locked. As, for instance on a closing of the padlock, a hoop end can first be inserted into the associated hoop receiver and is already held there, while the other hoop end can also be inserted into the other hoop receiver before both hoop ends are finally locked in their respective hoop receivers.

Alternatively to the permanent connection of the second hoop end to the lock body, an embodiment is therefore advantageous in which the hoop has a second hoop end, the lock body has a second hoop receiver in order to selectively receive the second hoop end therein and the lock body comprises a further blocking element which is displaceable between a blocked position in which it blocks the second hoop end against an exiting from the second hoop receiver and a release position in which it releases the second hoop end for an exiting from the second hoop receiver, with the drive element also locking the further blocking element in its blocked position in the locked position and also permitting a displacement of the further blocking element into its release position in the unlatched position.

This embodiment also has the advantage of the same parts or the same tools for the respective two hoop ends, hoop receivers and blocking elements. A similar configuration not only has advantages with respect to the production, but can additionally make it possible that there is no fixed association of the two hoop ends with the two hoop receivers. The first hoop end can thus, for instance, also be inserted into the second hoop receiver and the second hoop end into the first hoop receiver.

As in the preceding embodiment with a permanently connected second hoop end, the drive element also cooperates with the two blocking elements in this embodiment, with the two blocking elements, however, being released for a displacement into their respective release positions in the unlatched position of the drive element. Both hoop ends can consequently be locked or unlatched simultaneously, that is by the same locking actuation or unlatching actuation.

In principle, the named securing mechanism for securing a hoop end at the lock body, despite the unlatching, can only be provided for the first hoop receiver which is then, for example, correspondingly marked so that in each case the first hoop end is advantageously first inserted into the respective hoop receiver and only then is the second hoop end inserted into the respective hoop receiver. However, the securing mechanism is preferably provided for both hoop receivers so that the order of the insertion can be arbitrary.

For this reason, provision is made in a preferred further development that the drive element comprises a further latch element which is displaceably supported at the rotary body, wherein the further latch element is preloaded toward the further blocking element in the unlatched position in order to secure the further blocking element against an automatic displacement into the release position. The embodiments and further developments described above for the latch end can in this respect be transferred accordingly to the further latch element, whereby respective corresponding advantages result.

The lock body can furthermore have a housing in which the respective hoop receivers are configured and in which the respective blocking elements, the drive element and a closing mechanism, in particular a lock cylinder, are received. In this respect, it can in particular be advantageous in the field of application of lockout-tagout locks if the housing and optionally also the drive element have plastic and/or another electrically non-conductive material, in particular an isolating material, as the material. For if the padlock is, for example, connected to a switch for securing a plant and there is a risk that the lock body or the hoop, which is conductive as a rule, comes into contact with a possibly high electric voltage of the plant, it is thereby avoided that this voltage is transferred to the lock cylinder and thereby puts the user at risk on the actuation of the lock cylinder.

The provision of a plastic housing also provides cost advantages and can therefore in particular generally be useful in fields of application in which break-open attempts are not to be expected.

The invention will be described in more detail in the following only by way of example with reference to the Figures.

Mutually corresponding elements of different embodiments are in this respect marked by the same respective reference numerals.

Figure 1:
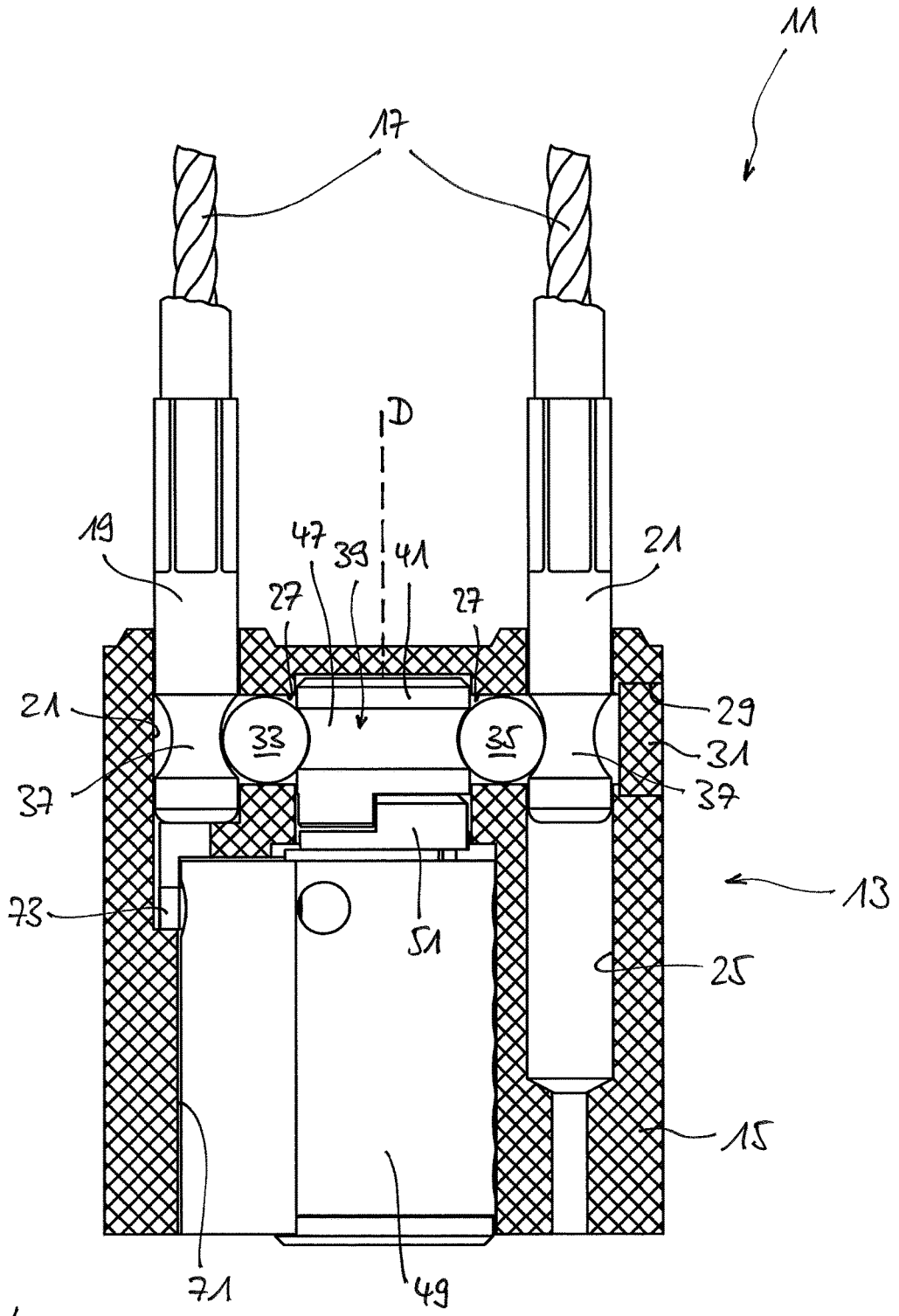
FIG. 1 shows an embodiment of a padlock in accordance with the invention in a vertical part sectional illustration.

The padlock 11 shown in FIG. 1 comprises a lock body 13 which comprises a housing 15 which in particular outwardly limits the lock body 13. To illustrate the parts present in the housing 15, the housing 15 is shown in a vertical sectional illustration, while the remaining parts are illustrated as solid bodies.

The padlock 11 is shown in a closed position in which a hoop 17 having a first hoop end 19 and a second hoop end 21 is connected to the lock body 13 such that the lock body 13 and the hoop 17 form a closed loop. The hoop 17 is in this respect configured as a flexible wire rope whose ends 19, 21 have rigidly configured sleeves. The hoop 17 is only partly illustrated and can have different lengths depending on the field of application of the padlock 11.

The padlock 11 is configured such that the first hoop end 19 can be selectively connected to the lock body 13, whereas the second hoop end 21 is permanently connected to the lock body 13.

To connect the hoop 17 to the lock body 13, a first hoop receiver 23 in which the first hoop end 19 is received in the closed position shown and a second hoop receiver 25 in which the second hoop end 21 is permanently received are provided in the lock body 13. The hoop receivers 23, 25 are configured as bores in the housing 15. The second hoop receiver 25 is deeper than the first hoop receiver 23 so that the housing 15 can, as shown, be used in the same manner of construction both with a flexible hoop 17 and with a rigid hoop whose hoop end which is permanently connected to the lock body 13 has to be displaceable in the associated hoop receiver.

The lock body 13 has a passage 27 which is horizontal in FIG. 1 and which is likewise configured as a bore in the housing 15. A lateral passage inlet 29 is closed by a plug 31 in a permanent manner and such that it is substantially not recognizable from the outside. A first blocking element 33 and a second blocking element 35 are respectively provided in the region of the respective opening of the passage 27 into the respective hoop receiver 23 or 25 in the passage 27 which connects the two hoop receivers 23, 25 to one another.

The blocking elements 33, 35 are configured as blocking balls and are present in a respective blocked position in FIG. 1 in which they engage into a respective peripheral restriction 37 of the first hoop end 19 or of the second hoop end 21. The two hoop ends 19, 21 are blocked against an exiting from the hoop receivers 23, 25 by this engagement. The peripheral restrictions 37 in this respect have a radius of curvature which corresponds to the radius of the blocking elements 33, 35.

The two blocking elements 33, 35 are generally displaceable within the passage 27. However, they are prevented from a displacement out of their respective blocked positions in the direction of the respective hoop receiver 23 or 25 by the respective hoop end 19 or 21; in the respective opposite direction, the blocking elements 33, 35 are locked against a displacement out of their respective blocked positions by a drive element 39. The drive element 39 is in this respect arranged in a central expanded region of the passage 27, which forms a rotary body receiver, between the blocking elements 33, 35.

The drive element 39 comprises a rotary body 41 as well as a latch element 43 which is rotatably supported at the rotary body 41 such that it is displaceable relative to the rotary body 41. As can in particular be recognized in FIG. 2, the latch element 43 is in this respect at least partly received in a latch receiver 45 of the rotary body 41 such that the latch element 43 cannot be recognized in FIG. 1.

The position of the drive element 39 (and thus also of the rotary body 41 and of the latch element 43) shown in FIG. 1 is the locked position of the drive element 39 in which said drive element locks the blocking elements 33, 35 in their respective blocked positions. For this purpose, the rotary body 41 substantially has the shape of a cylinder whose concave jacket surface contacts the blocking elements 33, 35 by way of the peripheral restriction 47 in the locked position.

As will in particular still be explained with reference to FIGS. 4A to 4D, the drive element 39 is rotatable about an axis of rotation D, which coincides with the cylinder axis of the cylinder shape of the rotary body 41 and which is aligned perpendicular to the extent of the passage 27, between the locked position shown (cf. also FIG. 4A) and an unlatched position (cf. FIG. 4C) in which a displacement of the first blocking element 33 in the direction away from the first hoop receiver 23 and toward the axis of rotation D is permitted.

The drive element 39 is rotated between the locked position and the unlatched position by a lock cylinder 49 which is received in a cylinder receiver 71 of the housing 15 and which operatively engages at the rotary body 41 of the drive element 39 via an entrainer 51. A locking actuation or an unlatching actuation by means of which the entrainer 51 of the lock cylinder 49 rotates the rotary body 41 of the drive element 39 into the locked position or into the unlatched position can only be carried out by means of a unique key, not shown, which is associated with the lock cylinder 49.

The rotational movability of the drive element 39 is in this respect limited by the lock cylinder 49 to the rotary angle range between the locked position and the unlatched position such that the drive element 39 can no longer be rotated beyond these positions in the assembled state of the padlock 11. The rotary angle range between the locked position and the unlatched position is in this respect preferably smaller than 180°, in particular smaller than 150°, and preferably comprises 90°, for instance.

Figure 2A:
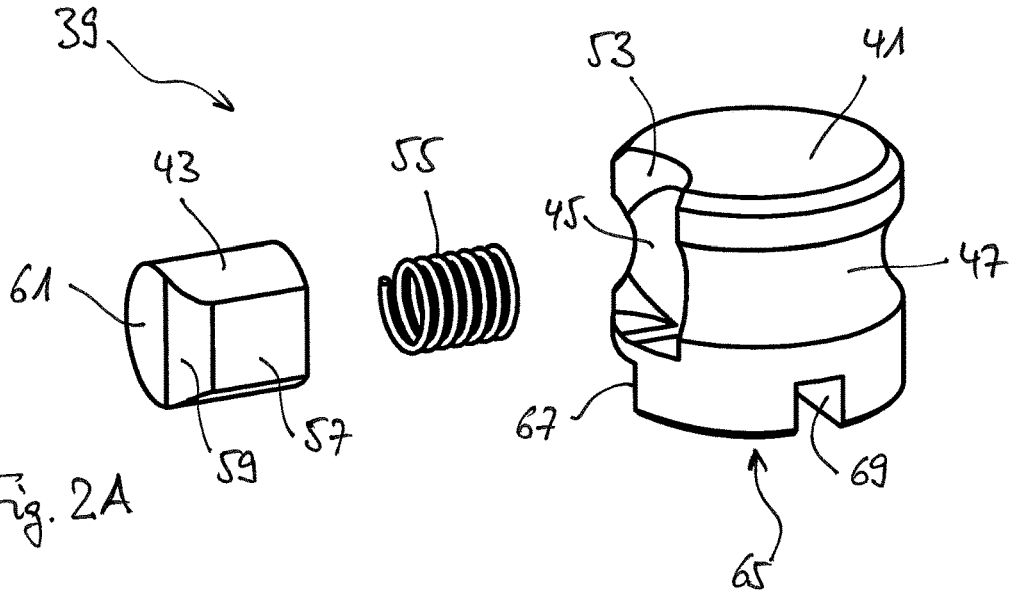
FIGS. 2A to 2C show a drive element of a padlock in accordance with the invention in a perspective exploded illustration; in a plan view and in a side view.
Figure 2B:
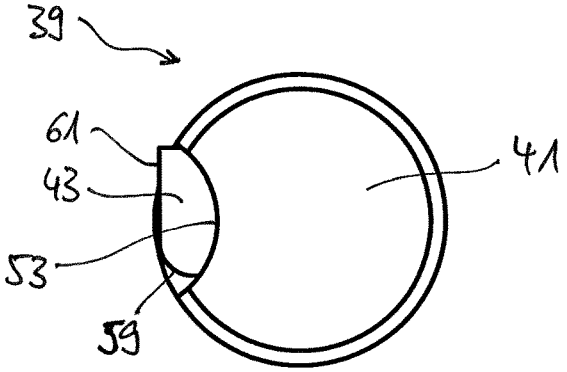
Figure 2C:
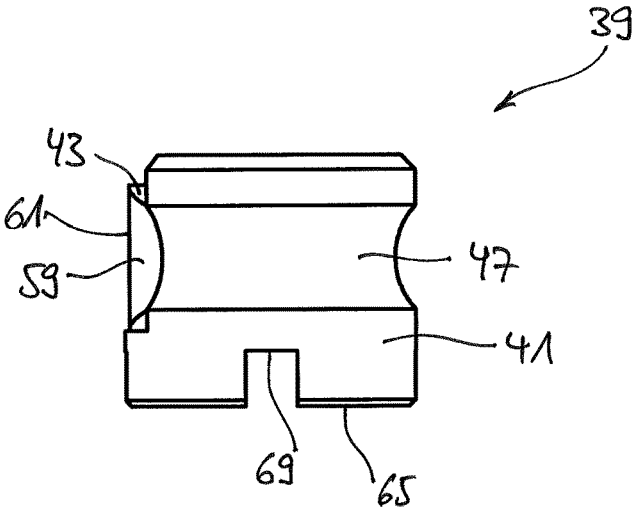

The drive element 39 is shown in detail in FIGS. 2A to 2C. As can be recognized in the perspective illustration of FIG. 2A and in the plan view of FIG. 2B, the jacket surface of the rotary body 41 has a recess 53 which is substantially in the shape of the arc of a circle in cross-section. In the unlatched position of the drive element 39, this recess 53 is aligned radially in the direction of the first blocking element 33 such that the first blocking element 33 can be partly received in the recess 53. This allows the blocking element 33 to exit its blocked position shown in FIG. 1 and to adopt a release position in which the first hoop end 19 can be removed from the first hoop receiver 23.

The latch receiver 45 configured in the rotary body 41 of the drive element 39 has the same alignment which is radial (with respect to the axis of rotation D) as the recess 53 and therefore opens into the recess 53. The latch element 43 and a spring element 55 are received in the latch receiver 45, said spring element being supported between an end face of the latch element 43 facing into the latch receiver 45 and a base of the latch receiver 45 and thereby radially preloading the latch element 43 in the direction out of the latch receiver 45. In the embodiment shown, the spring element 55 is a helical spring. However, the spring element 55 can generally also be configured in a different manner, in particular as a plate spring.

The latch element 43 is displaceable in the latch receiver 45 such that it can, on the one hand, be moved further into the latch receiver 45 against the preload and, on the other hand, can be moved further out of the latch receiver 45 by way of the preload or through the preload. The displaceability of the latch element 43 is in this respect likewise aligned radially with respect to the axis of rotation D due to the radial alignment of the latch receiver 45. The latch element 43 can therefore, on the one hand, be rotated together with the rotary body 41 about the axis of rotation D between the unlatched position and the latched position and, on the other hand, can additionally be displaced radially with respect to the axis of rotation D relative to the rotary body 41.

The latch element 43 and the latch receiver 45 have the same cross-section such that the latch element 43 is led in the latch receiver 45 in a sliding manner. The cross-section in this respect has the shape of a circular segment having a central angle of over 180°, in particular of approximately 270°, such that the latch element 43 is substantially configured as a cylinder-shaped pin which has a flat side 57 which is radial (with respect to a cylinder axis of the pin) and which is formed by the chord of the circular segment. Since the cross-section does not have any rotational symmetry, the rotational alignment (with respect to the cylinder axis) of the latch element 43 is clearly fixed in the latch receiver 45.

Figure 4A:
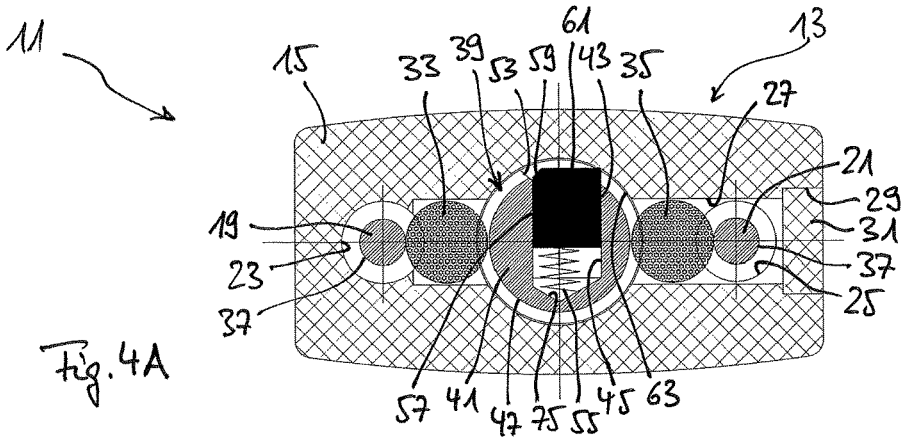
FIGS. 4A to 4D show a further embodiment of a padlock in accordance with the invention in different rotational positions of the drive element in a respective horizontal sectional illustration.
Figure 4B:
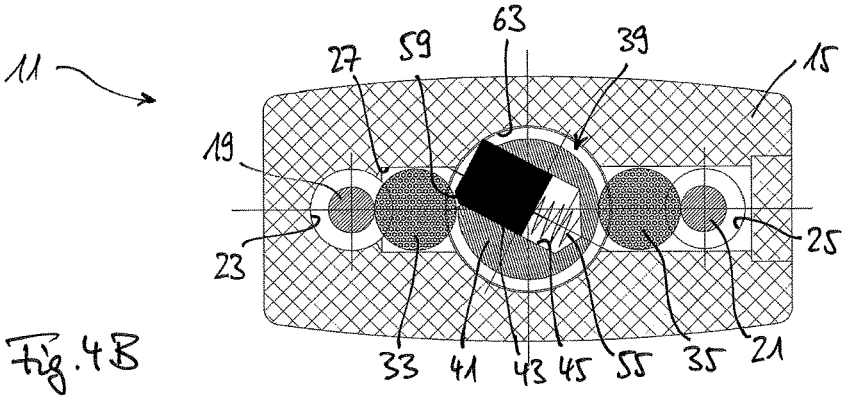

The transition 59 from the flat side 57 to an end face 61 which faces away from the latch receiver 45 and which faces the first blocking element 33 in the unlatched position is rounded off in order to be able to lead the latch element 43 past the first blocking element 33 more effectively on a rotation from the locked position into the unlatched position (cf. FIG. 4B, wherein the transition in the embodiment shown there is not rounded off, but chamfered, which serves the same purpose). The one-sided rounding off or chamfer 59 of the margin of the end face 61 can in particular be clearly recognized in FIG. 2B.

The radial position of the latch element 43 relative to the rotary body 39 shown in FIGS. 2B and 2C corresponds approximately to a neutral position of the latch element 43. (For better illustration of the shape of the latch element 43, the latch element 43 is shown slightly further out of the latch receiver 45 than it is arranged in the actual neutral position.) In the neutral position, the transition 59 and the end face 61 substantially form a continuation of the restriction 47 in the jacket surface of the rotary body 41.

The latch element is preloaded further in the direction out of the latch receiver 45 in the neutral position such that it does not adopt the neutral position in a released manner, but only when it is prevented from a further exiting from the latch receiver 45. In the locked position, the latch element 43 is prevented from exiting by a wall 63 which is formed in the housing 15 and along which the end face 61 brushes on rotating; in the unlatched position, the latch element 43 is prevented from exiting by way of the first blocking element 33, which is supported toward the first hoop end 19, when the padlock 11 is closed (cf. FIGS. 4A to 4C).

A step 67 and a groove 69 are provided at a lower side 65 of the rotary body 41. They form engagement surfaces for a torque transfer to the rotary body 41. The entrainer 51 can in particular be configured in such a manner that it drives the rotary body 41 in a shape-matched manner to carry out a rotational movement via at least one of these engagement surfaces.

The assembly of the embodiment of a padlock 11 shown in FIG. 1 is explained with reference to FIGS. 3A to 3F which show different assembly states in a chronological sequence in a respective illustration which corresponds to FIG. 1.

Figure 3C:
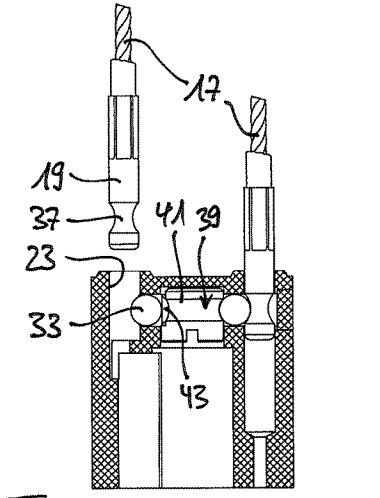
FIGS. 3A to 3F show the embodiment shown in FIG. 1 in an assembly sequence.
Figure 3F:
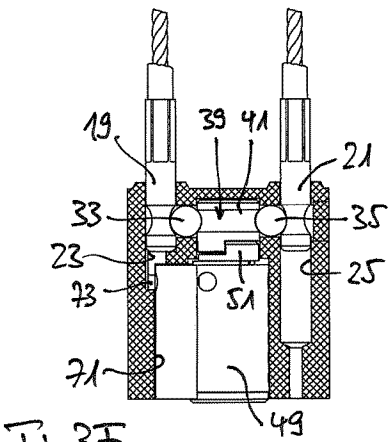
Figure 3B:
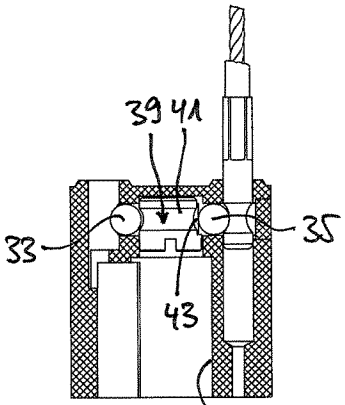
Figure 3E:
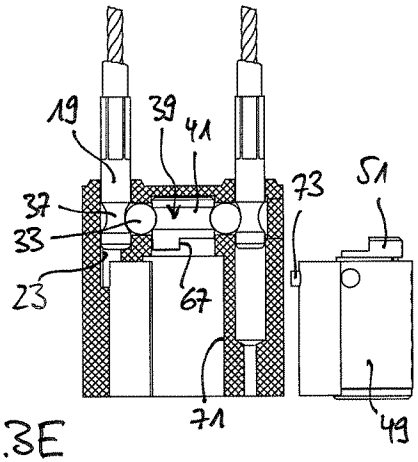
Figure 3A:
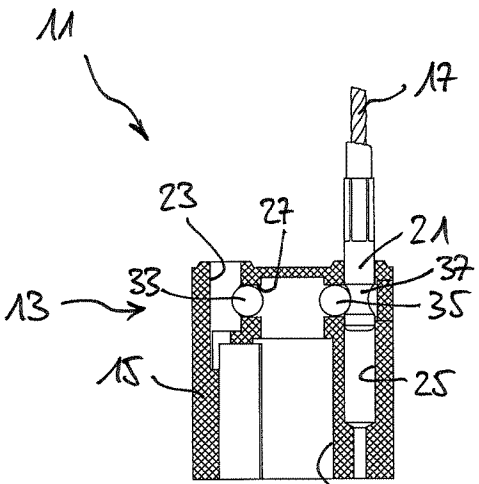

In FIG. 3A, the housing 15 of the padlock 11 is shown into which the second hoop end 21 has already initially been inserted into the second hoop receiver 25 and the two blocking elements 33, 35 were subsequently inserted into the passage 27 through the cylinder receiver 71 provided in the housing 15 such that at least the second blocking element 35 adopts its blocked position.

As FIG. 3B shows, the drive element 39 is subsequently in turn inserted between the blocking elements 33, 35 via the cylinder receiver 71 with its rotary body 41 and with the latch element 43 and the spring element 55 (which is not visible) which are received in the latch receiver 45 of the rotary body 43. In this respect, the recess 53 of the rotary body 41 (cf. FIG. 2) and the preloaded latch element 43 face the direction of the second blocking element 35 in order to be able to be led past said blocking element. The rotary body 41 can be led past the first blocking element 33, since the blocking element 33 can move beyond its blocked position in the direction of the first hoop receiver 23 as long as the first hoop end 19 has not yet been received in the first hoop receiver 23.

The drive element 39 is subsequently rotated out of the rotational position shown in FIG. 3B (which is no longer accessible with the padlock 11 assembled) into the unlatched position which is shown in FIG. 3C and in which the recess 53 of the rotary body 41 and the preloaded latch element 43 face the direction of the first blocking element 33. Consequently, the second blocking element 35 is from then on locked in its blocked position by the restriction 47 in the jacket surface of the rotary body 41, in which blocked position it engages into the restriction 37 of the second hoop end 21 and thereby permanently blocks the second hoop end 21 in the second hoop receiver 25.

Figure 3D:
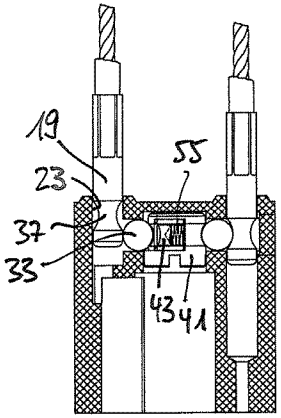

Due to the fact that the first blocking element 33 can be displaced into its release position shown in FIG. 3D against the preload of the latch element 43, the first hoop end 19 can now be inserted into the first hoop receiver 23 past the first blocking element 33. If the first hoop end 19 is received in the first hoop receiver 23, that is the restriction 37 of the first hoop end 19 is aligned with the passage 27, the first blocking element 33, driven by the preloaded latch element 43, engages into the restriction 37 and thus already secures the first hoop end 19 in the first hoop receiver 23. In this state, the first hoop end 19 can, however, still be removed again from the first hoop receiver 23 even if only by overcoming a force threshold.

The drive element 39 is subsequently rotated into the locked position shown in FIG. 3E so that the first blocking element 33 now also contacts the restriction 47 of the rotary body 39 and is thereby locked in the blocked position blocking the first hoop end 19. In this state, the first hoop end 19 and the second hoop end 21 are thus locked against an exiting from the respective hoop receiver 23 or 25, wherein the locking of the first hoop end 19, in contrast to the locking of the second hoop end 21, is also not permanent with the padlock 11 assembled, but can be cancelled again.

Finally, the lock cylinder 49 is inserted into the cylinder receiver 71—as shown in FIG. 3F which is identical to FIG. 1—such that its entrainer 51 is operatively coupled to the rotary body 41. In order to hold the lock cylinder 49 in the housing 15, the lock cylinder 49 has a laterally projecting locking pin 73 which is resiliently supported. The locking pin 73 is urged back in order to insert the lock cylinder 49 into the cylinder receiver 71. If the lock cylinder 49 is inserted completely, the locking pin 73 automatically exits again due to the resilient support and engages into an extension of the first hoop receiver 23 such that the lock cylinder 49 is securely held in the housing 15. In this manner, the further components received in the housing 15 of the padlock 11 are also secured against access. However, a release of the lock cylinder 49 from the housing 15 is still possible, for instance for a dismantling or a replacement of the lock cylinder 49. For this purpose, the locking pin 73 can be urged back again through the first hoop receiver 23 in an open position of the padlock 11 in which the first hoop end 19 is removed from the first hoop receiver 23.

It can be recognized with reference to the sequence which is described and which is illustrated in FIGS. 3A to 3F that the assembly can take place without tools. In addition, the housing 15 does not have to be processed for the assembly of the padlock 11 so that it can be completely preprocessed. The passage inlet 29 is in particular already permanently closed by the plug 31 and any other processing of the housing 15 also does not have to take place so that the housing 15 can, for instance, have a coating or coloring which is not impaired by the assembly.

FIGS. 4A to 4D show a further embodiment of the padlock 11 which substantially differs from the above-described embodiment in that the base of the latch receiver 45 has a depression 75 for the reliable centering and alignment of the spring element 55 and in that the transition 59 between the flat side 57 and the end face 61 of the latch element 43 has a chamfer instead of a rounding off.

FIG. 4A shows the drive element 39 in the locked position. In this position, the first blocking element 33 is locked in its blocked position and therefore blocks the first hoop end 19 against an exiting from the first hoop receiver 23. In the locked position, the latch element 43 is urged out of the latch receiver 45 toward the wall 63 by the spring element 55 and thereby adopts the radial neutral position shown.

Figure 4C:
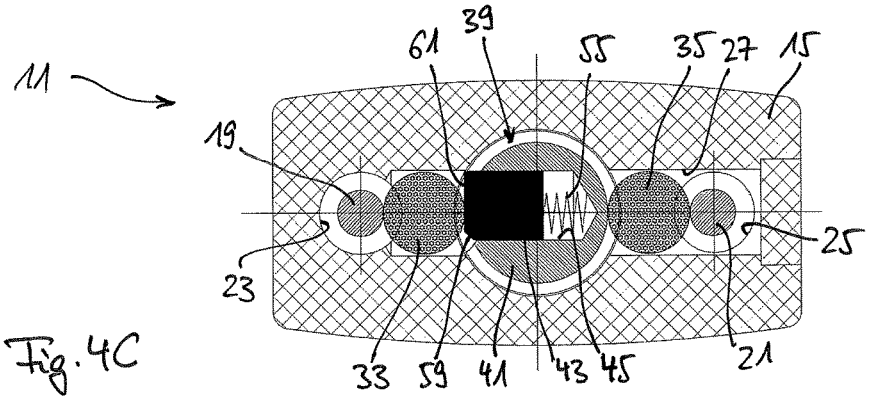

The drive element 39 can be rotated from the locked position into the unlatched position shown in FIG. 4C. In this respect, the transition 59 is urged toward the first blocking element 33 as shown in FIG. 4B. The leading of the transition 59 past the first blocking element 33 is facilitated by way of the chamfer, wherein, on the leading past, the latch element 43 is slightly displaced first against the preload and then through the preload in the opposite direction. Otherwise, the latch element 43, however, maintains its radial neutral position.

The latch element 43 is then radially aligned in the unlatched position such that its end face 61 acts on the first blocking element 33 in a frontal manner as a consequence of the preload. The first blocking element 33 is thereby held unchanged in its blocked position despite the unlatching which has taken place. However, the first blocking element 33 can now be displaced into the release position against the preload force of the spring element 55 in the direction of the latch element 43 such that the first hoop end 19 can be removed from the first hoop receiver 23. The displacement of the first blocking element 33 into the release position in this respect in particular takes place as a consequence of a tensile force on the first hoop end 19 from out of the first hoop receiver 23 which has to exceed a certain force threshold and is then sufficient to displace the first blocking element 33 in the direction of the drive element 39.

Figure 4D:
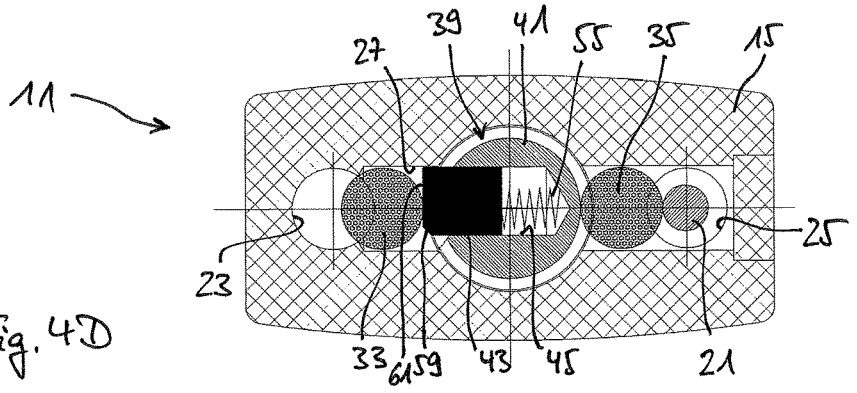

It can be recognized in FIG. 4D that the passage 27 is configured such that the first blocking element 33 can be displaced further in the direction of the first hoop receiver 23 beyond its blocked position when the first hoop receiver 23 is free and is also displaced due to the preload of the latch element 43. As long as the first hoop end 19 is received in the first hoop receiver 23, such a displacement is, in contrast, not possible.

When the first hoop receiver 23 is free, the latch element 43 therefore adopts the radial rotation-blocking position which is shown in FIG. 4D and in which it projects further out of the latch receiver 45 than in the neutral position and in this respect engages into the part of the passage 27 provided for the reception and guidance of the first blocking element 33. A particularly stable engagement is in particular achieved in that the passage 27 and the latch element 43 (with respect to its general cylinder shape) have the same diameter.

When a torque is exerted onto the drive element 39 in the direction of the locked position in the rotation-blocking position of the latch element 43, that is when an attempt is made to move the padlock 11 into a locked state, the latch element 43 abuts a wall of the passage 27 and thus blocks the rotation. It is reliably prevented in this manner that the padlock 11 is displaced into a locked state in an open state in which the first hoop end 19 is not received in the first hoop receiver 23. Since the lock cylinder 49 additionally only permits a removal of the key (not shown) associated with it from the lock cylinder 49 when the lock cylinder 49 and thus also the drive element 39 adopt their locked positions, it is ensured in this manner in the sense of a forced locking that the key can only be removed when the padlock 11 is closed and locked.

The rotation-blocking position of the latch element 43 shown in FIG. 4D is cancelled again in a simple manner in that the first hoop end 19 is pushed into the first hoop receiver 23. The first blocking element 33 is thereby first urged into the release position against the preload of the latch element 43 beyond the closed position and is directly thereafter displaced back into the closed position by the preload with the first hoop end 19 correctly received in the first hoop receiver 23 such that the state shown in FIG. 4C is present again. The latch element 43 is then present in its neutral position again such that the drive element 39 can then again be displaced into the locked position in order to lock the padlock 11.

REFERENCE NUMERAL LIST

11 padlock
13 lock body
15 housing
17 hoop
19 first hoop end
21 second hoop end
23 first hoop receiver
25 second hoop receiver
27 passage
29 passage inlet
31 plug
33 first blocking element
35 second blocking element
37 restriction
39 drive element
41 rotary body
42 latch element
45 latch receiver
47 restriction
49 lock cylinder
51 entrainer
53 recess
55 spring element
57 flat side
59 transition
61 end face
63 wall
65 lower side
67 step
69 groove
71 cylinder receiver
73 locking pin
75 recess
D axis of rotation

The invention claimed is:

1. A padlock comprising a lock body and a hoop having a first hoop end, wherein the lock body has a first hoop receiver in order to selectively receive the first hoop end therein;

wherein the lock body comprises a blocking element which is displaceable between a blocked position in which it blocks the first hoop end against an exiting from the first hoop receiver and a release position in which it releases the first hoop end for an exiting from the first hoop receiver;

and wherein the lock body comprises a drive element which is rotatable between a locked position in which it locks the blocking element in its blocked position and an unlatched position in which it permits a displacement of the blocking element into its release position, wherein the drive element comprises a rotary body and a latch element which is displaceably supported by the rotary body relative to the rotary body, and wherein the latch element is preloaded toward the blocking element in the unlatched position in order to secure the blocking element against an automatic displacement into the release position.

2. The padlock in accordance with claim 1, wherein the hoop is a flexible hoop.

3. The padlock in accordance with claim 1, wherein the latch element is radially displaceable with respect to an axis of rotation of the drive element.

4. The padlock in accordance with claim 1, wherein the rotary body has a latch receiver in which the latch element is received.

5. The padlock in accordance with claim 4, wherein a spring element is further received in the latch receiver, said spring element preloading the latch element in the direction out of the latch receiver.

6. The padlock in accordance with claim 4, wherein the latch receiver is aligned in the direction of the blocking element in the unlatched position.

7. The padlock in accordance with claim 4, wherein a cross-section of the latch receiver and a cross-section of the latch element are formed in a complementary manner with respect to one another.

8. The padlock in accordance with claim 4, wherein the latch receiver and the latch element are configured in such a manner that a rotational alignment of the latch element is fixed in the latch receiver.

9. The padlock in accordance with claim 1, wherein the blocking element at least substantially has a spherical shape.

10. The padlock in accordance with claim 1, wherein the latch element has a cylindrical basic shape;

wherein a transition from a jacket surface of the latch element is rounded off or chamfered toward an end face facing the blocking element in the unlatched position;

and wherein the transition is radially aligned in such a manner that it is led past the blocking element on the rotation of the drive element from the locked position into the unlatched position.

11. The padlock in accordance with claim 1, wherein the rotary body has a cylindrical basic shape with a jacket surface which locks the blocking element in its blocked position in the locked position and which has a recess which is aligned toward the blocking element in the unlatched position and which permits a displacement of the blocking element into its release position.

12. The padlock in accordance with claim 11, wherein the jacket surface is a concavely formed jacket surface.

13. The padlock in accordance with claim 11, wherein the latch element extends into the recess while it secures the blocking element against an automatic displacement into the release position.

14. The padlock in accordance with claim 1, wherein the lock body comprises a lock cylinder which is operatively coupled to the drive element in order to rotate the drive element between the locked position and the unlatched position in dependence on an actuation of the lock cylinder.

15. The padlock in accordance with claim 1, wherein the lock body comprises a lock cylinder which is operatively coupled to the rotary body, in order to rotate the drive element between the locked position and the unlatched position in dependence on an actuation of the lock cylinder.

16. The padlock in accordance with claim 1, wherein the hoop has a second hoop end which is permanently connected to the lock body.

17. The padlock in accordance with claim 10, wherein the second hoop end is permanently received in a second hoop receiver of the lock body.

18. The padlock in accordance with claim 10, wherein the lock body comprises a further blocking element which blocks the second hoop end against an exiting from the second hoop receiver in a blocked position;

and wherein the drive element locks the further blocking element in its blocked position both in the locked position and in the unlatched position.

19. The padlock in accordance with claim 1, wherein the hoop has a second hoop end;

wherein the lock body has a second hoop receiver in order to selectively receive the second hoop end therein;

and wherein the lock body comprises a further blocking element which is displaceable between a blocked position in which it blocks the second hoop end against an exiting from the second hoop receiver and a release position in which it releases the second hoop end for an exiting from the second hoop receiver, with the drive element also locking the further blocking element in its blocked position in the locked position and also permitting a displacement of the further blocking element into its release position in the unlatched position.

20. The padlock in accordance with claim 19, wherein the drive element comprises a further latch element which is displaceably supported at the rotary body; and wherein the further latch element is preloaded toward the further blocking element in the unlatched position in order to secure the further blocking element against an automatic displacement into the release position.

21. A padlock comprising a lock body and a hoop having a first hoop end, wherein the lock body has a first hoop receiver in order to selectively receive the first hoop end therein;

wherein the lock body comprises a blocking element which is displaceable between a blocked position in which it blocks the first hoop end against an exiting from the first hoop receiver and a release position in which it releases the first hoop end for an exiting from the first hoop receiver;

and wherein the lock body comprises a drive element which is rotatable between a locked position in which it locks the blocking element in its blocked position and an unlatched position in which it permits a displacement of the blocking element into its release position, wherein the drive element comprises a rotary body and a latch element which is displaceably supported at the rotary body relative to the rotary body, and wherein the latch element is preloaded toward the blocking element in the unlatched position in order to secure the blocking element against an automatic displacement into the release position, wherein the latch element has a cylindrical basic shape whose cross-section is a circular segment such that the latch element has a radial flat side.

22. The padlock in accordance with claim 21, wherein a transition from the radial flat side is rounded off or chamfered toward an end face of the latch element facing the blocking element in the unlatched position and is aligned in such a manner that it is led past the blocking element on the rotation of the drive element from the locked position into the unlatched position.

23. A padlock comprising a lock body and a hoop having a first hoop end, wherein the lock body has a first hoop receiver in order to selectively receive the first hoop end therein;

wherein the lock body comprises a blocking element which is displaceable between a blocked position in which it blocks the first hoop end against an exiting from the first hoop receiver and a release position in which it releases the first hoop end for an exiting from the first hoop receiver;

and wherein the lock body comprises a drive element which is rotatable between a locked position in which it locks the blocking element in its blocked position and an unlatched position in which it permits a displacement of the blocking element into its release position, wherein the drive element comprises a rotary body and a latch element which is displaceably supported at the rotary body relative to the rotary body, and wherein the latch element is preloaded toward the blocking element in the unlatched position in order to secure the blocking element against an automatic displacement into the release position, wherein, in the unlatched position of the drive element, the latch element is preloaded in the direction of a rotation-blocking position in which the latch element blocks a rotation of the drive element into the locked position; and wherein the latch element is blocked against a displacement into the rotation-blocking position as long as the first hoop end is received in the first hoop receiver.

24. The padlock in accordance with claim 23, wherein the latch element is blocked against a displacement into the rotation-blocking position by the blocking element as long as the first hoop end is received in the first hoop receiver.

25. The padlock in accordance with claim 24, wherein, in addition to its displaceability between the release position and the blocked position, the blocking element is furthermore displaceable beyond the blocked position in the direction toward the first hoop receiver; and wherein the blocking element is blocked by the first hoop end against a displacement in the direction of the first hoop receiver beyond the blocked position as long as the first hoop end is received in the first hoop receiver.

26. The padlock in accordance with claim 23, wherein, in the rotation-blocking position, the latch element abuts a stationary element of the lock body on a rotational actuation in the direction of the locked position, whereby a rotation of the drive element into the locked position is blocked.

27. The padlock in accordance with claim 23, wherein the lock body has a passage in which the blocking element is displaceably supported and into which the latch element engages in the rotation-blocking position.

28. The padlock in accordance with claim 23, wherein, in the unlatched position of the drive element, the latch element is displaceable between a release position which corresponds to the release position of the blocking element and into which the latch element can be urged against the preload on a displacement of the blocking element into its release position; a neutral position which corresponds to the blocked position of the blocking element and in which the latch element is preloaded toward the blocking element in order to secure the blocking element against an automatic displacement into its release position; and the rotation-blocking position.

* * * * *